US006848539B2

(12) United States Patent
Lee et al.

(10) Patent No.: US 6,848,539 B2
(45) Date of Patent: Feb. 1, 2005

(54) WORK PLATFORM FOR BLOWOUT PREVENTER STACKS

(75) Inventors: Oral Robert Lee, Houston, TX (US); John Alex Bibaeff, Jr., LaFayette, LA (US)

(73) Assignee: Global Marine Inc., Houston, TX (US)

( * ) Notice: Subject to any disclaimer, the term of this patent is extended or adjusted under 35 U.S.C. 154(b) by 0 days.

(21) Appl. No.: 10/362,678

(22) PCT Filed: Aug. 28, 2001

(86) PCT No.: PCT/US01/26807

§ 371 (c)(1),
(2), (4) Date: Feb. 24, 2003

(87) PCT Pub. No.: WO02/18727

PCT Pub. Date: Mar. 7, 2002

(65) Prior Publication Data

US 2004/0011592 A1 Jan. 22, 2004

(51) Int. Cl.[7] ..... E04G 1/36; E04G 1/16
(52) U.S. Cl. ..... 182/128; 182/113
(58) Field of Search ..... 182/113, 141, 182/128, 222, 142

(56) References Cited

U.S. PATENT DOCUMENTS

| | | | | |
|---|---|---|---|---|
| 335,164 A | | 2/1886 | Vitalis | |
| 1,070,910 A | | 8/1913 | Nichols | |
| 2,066,984 A | * | 1/1937 | Lamb | 182/113 |
| 3,193,974 A | | 7/1965 | Nelson et al. | |
| 4,407,392 A | * | 10/1983 | Lazzari | 182/128 |
| 5,203,410 A | * | 4/1993 | Cobb et al. | 166/95.1 |
| 5,653,418 A | * | 8/1997 | Olson | 251/1.3 |

* cited by examiner

*Primary Examiner*—Hugh B. Thompson, II
(74) *Attorney, Agent, or Firm*—Christie, Parker & Hale, LLP

(57) ABSTRACT

For the safety and convenience of personnel working on upper portions of a blowout preventer stack (10), a work platform (25) is supported at the midheight of the stack. The platform has a main support structure (26) which is affixable to central connection flanges in the stack. Auxiliary support members (33) are releasably affixable to arms (27) of the main structure, and to them are releasably affixable separate personnel support deck units (38). Guard rails (42) can be connected to the deck units. The platform is modular for easy mounting and demounting to the stack. The platform's main support structure (26) can be a long term element of the stack if desired.

12 Claims, 8 Drawing Sheets

WORK PLATFORM FOR BLOWOUT PREVENTER STACKS

This application claims benefit of Ser. No. 60/228,475 filed Aug. 28, 2000.

FIELD OF THE INVENTION

This invention pertains to a work platform for use in performing service and maintenance activities in the upper portion of a blowout preventer stack in association with oil and gas drilling operations.

BACKGROUND OF THE INVENTION

In the course of drilling oil or gas wells, whether on land or at subsea locations, blowout preventers (BOPs) are installed on the wellhead shortly after the initial portion of a well has been drilled and initial well casing has been installed in the well below the wellhead. Further well formation operations are performed through the BOPs.

A BOP is a set of opposing hydraulic rams. The rams are located on opposite sides of a central bore through a housing in which the rams and related devices are contained. The fundamental use of a BOP is to suitably close the bore in the BOP housing and thereby seal the well from flow of fluids out of the well in a situation in which the well experiences a high pressure event which cannot be controlled or regulated by other techniques or processes. A high pressure event typically occurs where the well bore is advanced into a geologic zone containing oil or gas at a pressure which is above the bore pressure established by a column of drilling mud presented to the zone. The drilling mud is presented to the zone via a string of drill pipe which extends through the bores of the BOPs into the well to a drill bit at the lower end of the drill pipe string. In such a situation, the zone pressure forces the drilling mud upwardly out of the well. If oil or gas at the zone pressure is allowed to flow past the wellhead, an incident which is hazardous to the environment and to personnel working on the well can occur. When overly high zone pressure is sensed during well drilling, as by a change in the flow of drilling mud at or adjacent the platform where drilling personnel are located, the rams of the BOP are actuated to effect the desired kind of sealing action at the wellhead. Different kinds of sealing action are possible, depending upon the construction details of a BOP.

Well drilling involves the use of a drill bit to engage and penetrate the rock or other geologic formation in which the well bore is being formed. As noted, the drill bit is carried at the lower end of a length (called a string) of drill pipe which extends upwardly in the well, through the wellhead and one or more BOPs at the wellhead, and to the drilling platform. The drilling platform can be located on land over the wellhead and the BOPs, or it can be located substantially above the wellhead in the case of a subsea well. BOPs can be defined to close the annulus in the BOP around a drill string of specified outer diameter, or to close the BOP bore in the absence of a drill string in that bore, or to shear a drill string in the bore and seal the BOP bore. Because a formation overpressure condition can be encountered at any time during well drilling operations, including times when no drill string extends through the wellhead, current well drilling practices rely upon a series of several BOPs at the wellhead; each BOP is configured for well sealing use in a particular condition. The several BOPs are arranged in a stack with their bores aligned, often with other devices present in the stack. The other devices can include a wellhead connector at the bottom of the stack, and an annular ramless BOP, usually at the top of the stack, which operates as a sphincter in the presence or absence of a drill string extending through it.

Oil and gas wells are being drilled into deeper and deeper formations, via both on-land and subsea wells. Subsea wells are being drilled in greater and greater water depths. Modern offshore drilling facilities, such as drillships, are now rated for drilling in water depths as great as 10,000 feet. In those wells, very high zone pressures can be encountered; zone pressures of 20,000 pounds per square inch or higher are known. To be able to operate against and to contain fluids at such pressures, BOPs are becoming larger and stronger. BOP stacks, including related devices, 30 feet or more in height are increasingly common.

As noted above, ram-type BOPs which close around drill pipe are designed and constructed for use with drill pipe of specified diameter. A BOP stack including rams for one size of pipe may be used with pipe of a different size by changing the pipe engaging rams or parts of the rams. Also, the ram operating mechanisms in a BOP are comparatively complex and require inspection and servicing before the BOP is put into service at a wellhead. Such activities, when performed in a large modern BOP stack, may require the presence of personnel at locations well above the bottom of the stack at heights which can be hazardous. The use of safety harnesses by stack service personnel is known, but has been found to restrict movement of personnel in the performance of their tasks. A need exists for a better way to provide safe support for personnel engaged in activities in the upper portions of large BOP stacks.

SUMMARY OF THE INVENTION

This invention addresses the need identified above. It provides a substantially demountable platform for supporting workers at an intermediate level on a BOP stack. The platform has a base armature which is connectible to the BOP stack around a stack axis and which provides a pair of primary arms extending in opposite directions, radially from the axis. A cross arm is demountably connectible to the end of each primary arm to extend in opposite lateral directions from the armature. A worker support deck unit is demountably connectible between he support arms, one along each side of the armature. Guard rail assemblies can be inserted into and secured in receptacles therefor in the deck unit. The armature can remain connected to the BOP stack after disconnection of the cross arms and the deck units from the armature, if desired.

BRIEF DESCRIPTION OF THE DRAWINGS

A presently preferred work platform according to this invention is described below with reference to the accompanying drawings in which.

DESCRIPTION OF THE ILLUSTRATED WORK PLATFORM EMBODIMENTS

Figure 1:
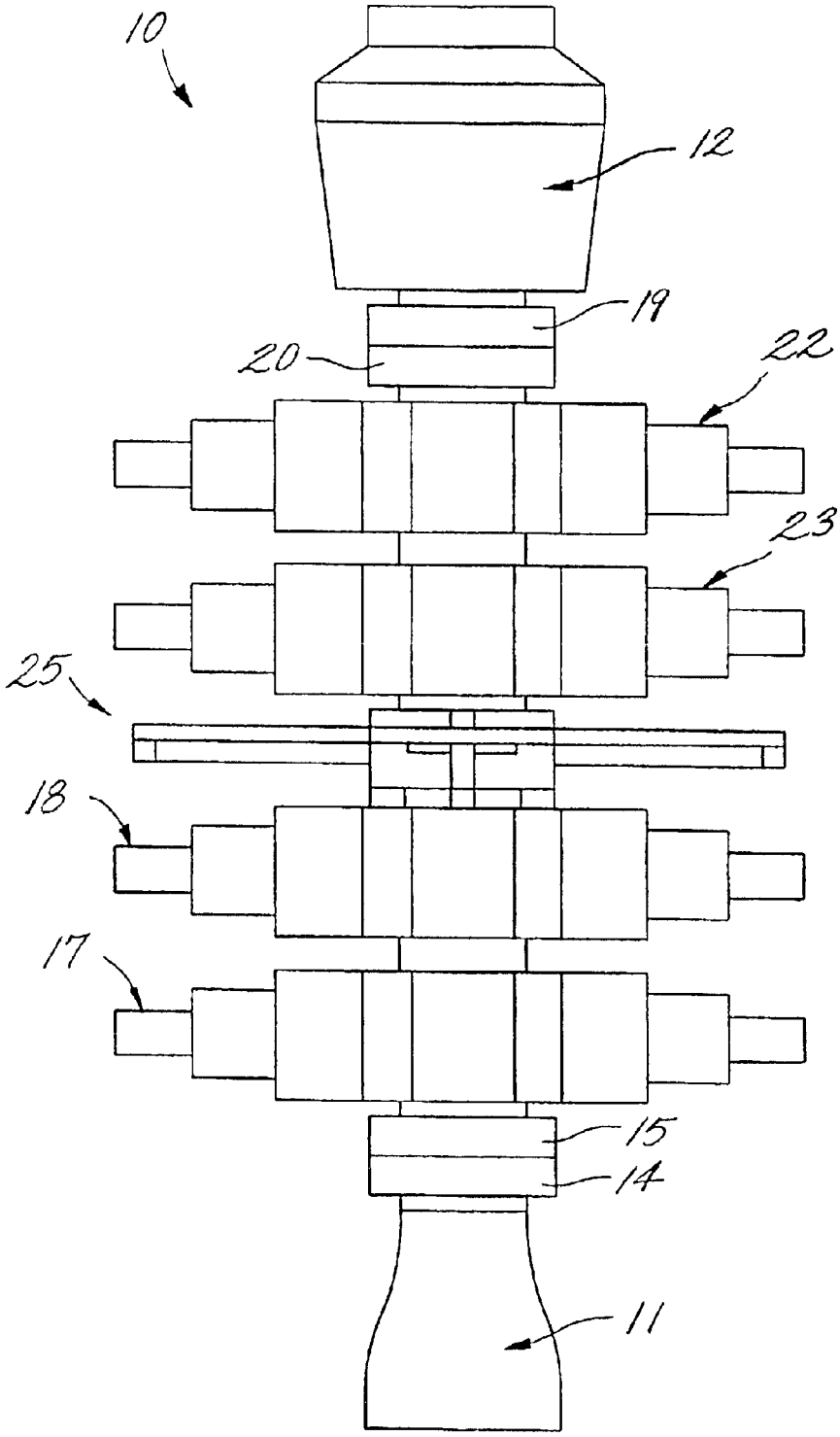
FIG. 1 is an elevation view of a BOP stack to which is mounted the armature and certain other structure of the work platform.
Figure 2:
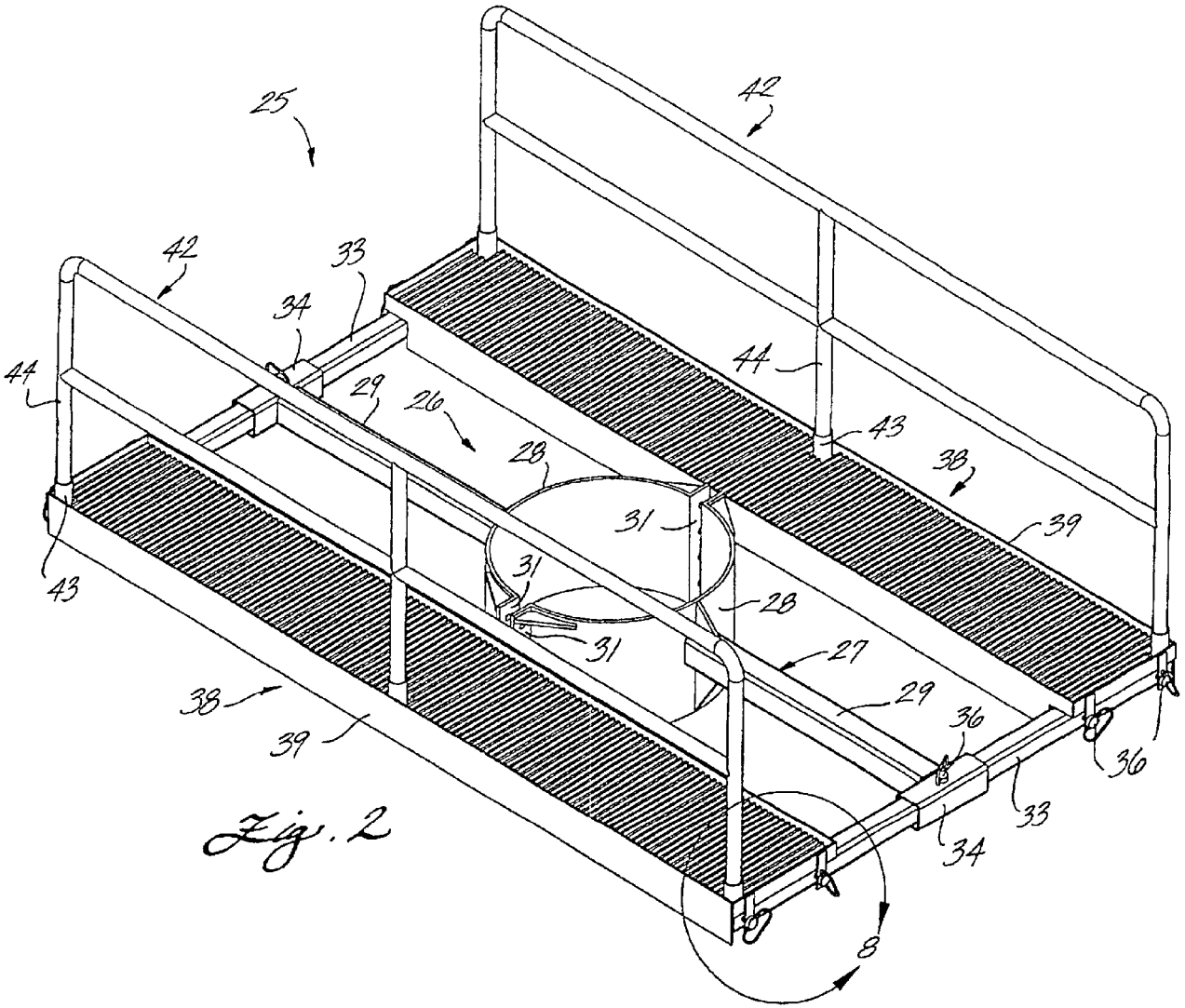
FIG. 2 is a perspective view of the work platform per se, apart from a BOP stack.
Figure 3:
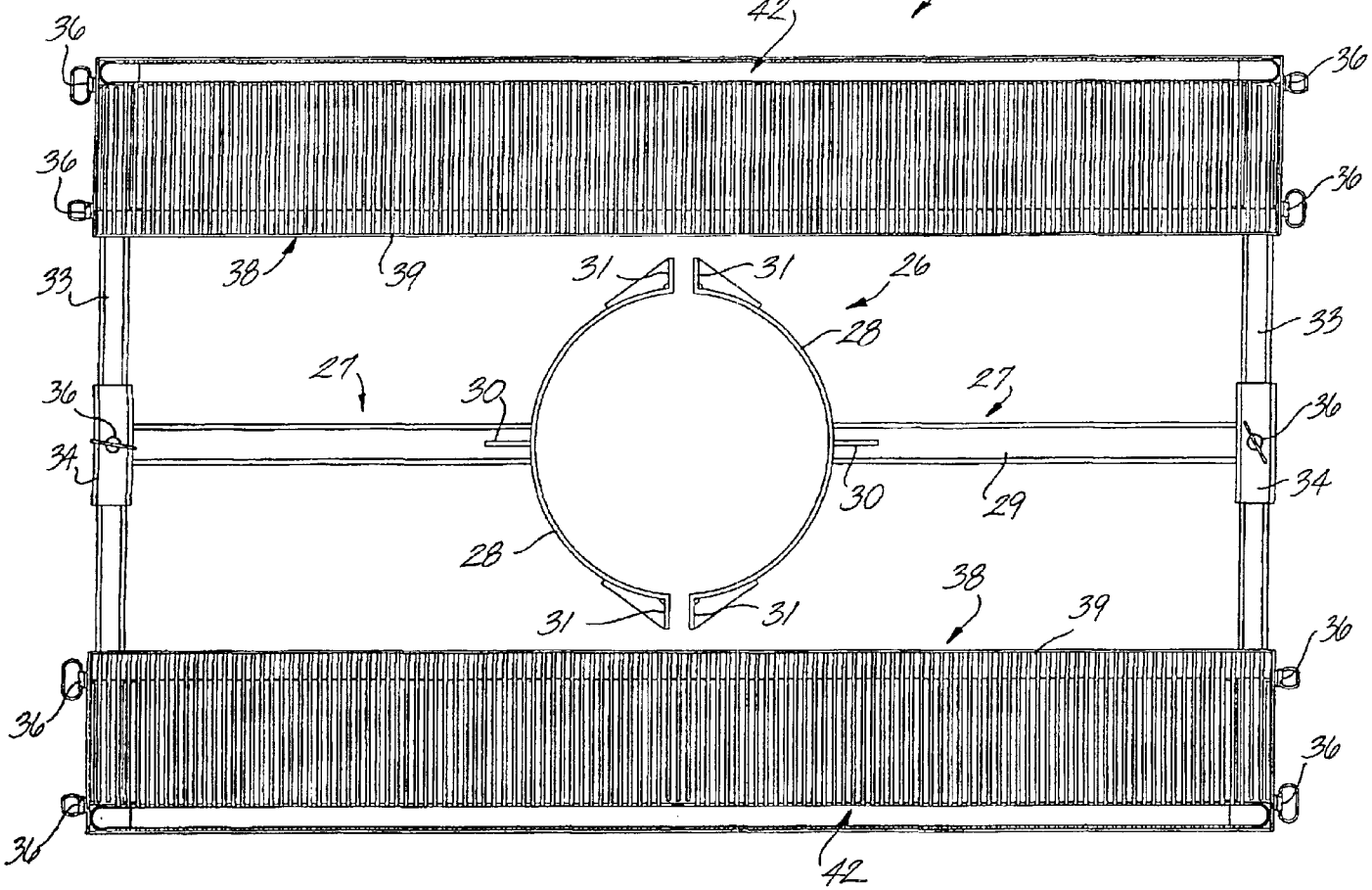
FIG. 3 is a top plan view of the work platform.
Figure 4:
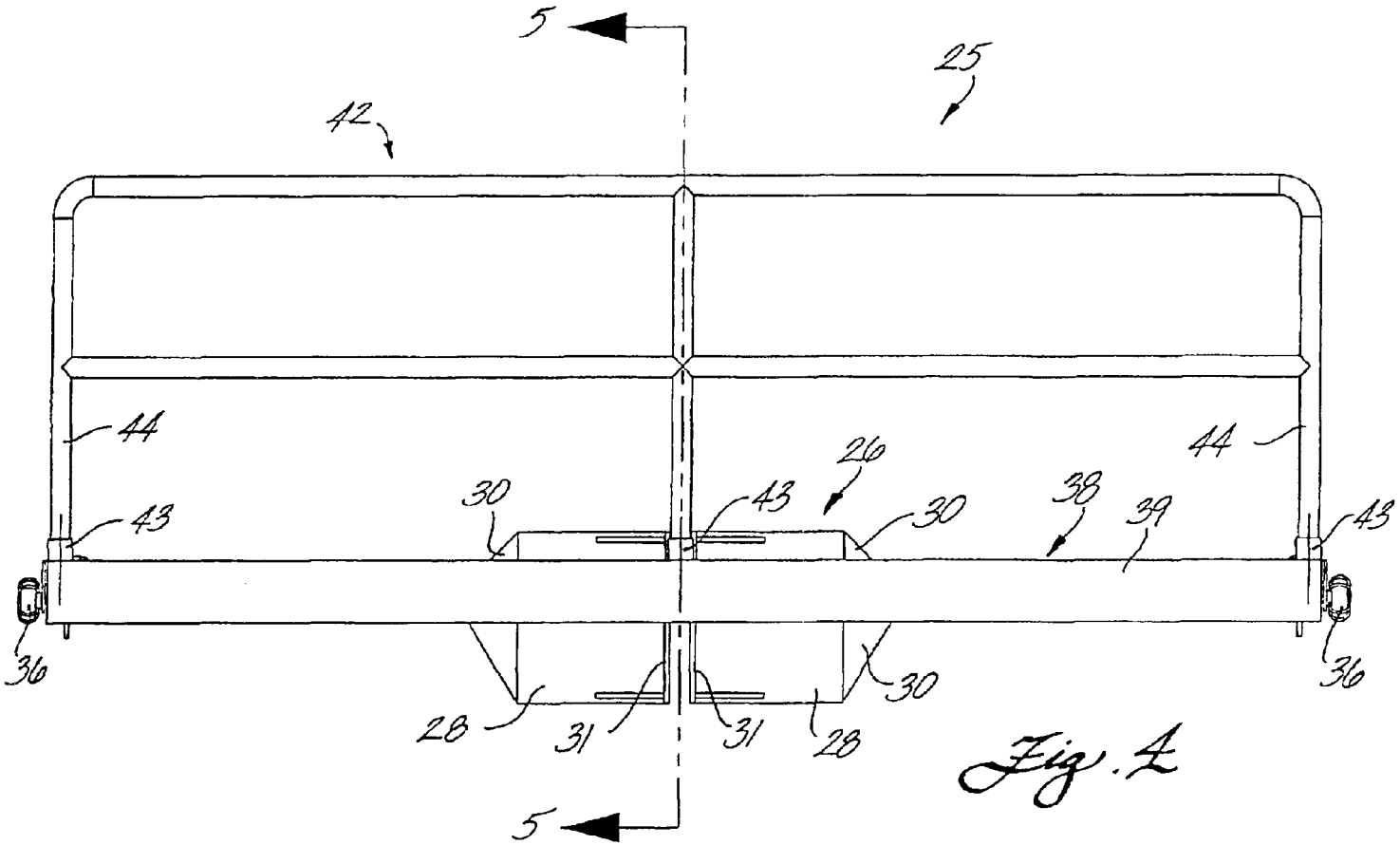
FIG. 4 is a side elevation view of the platform.
Figure 5:
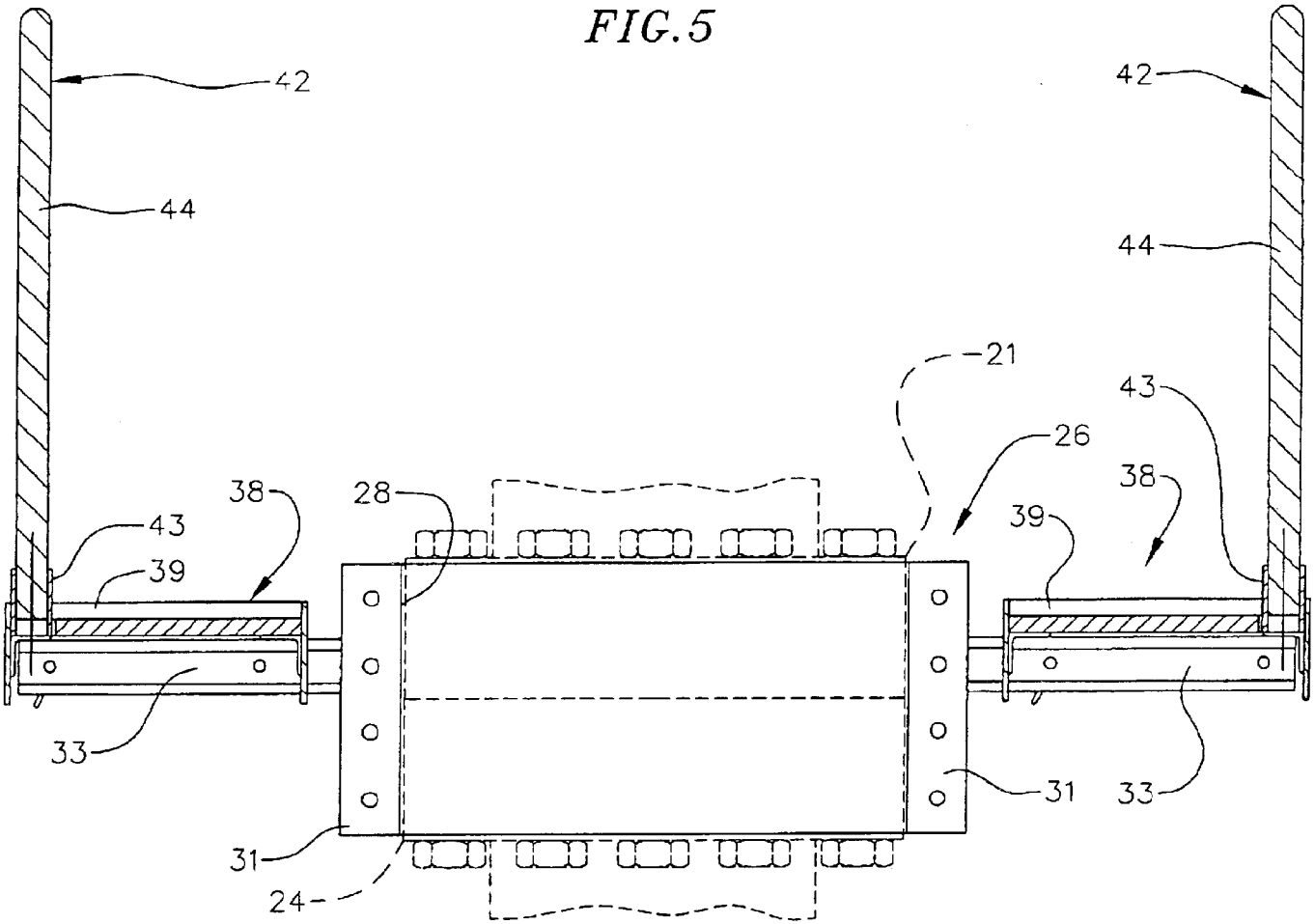
FIG. 5 is a cross-sectional view taken along line 5—5 in FIG. 4.
Figure 6:
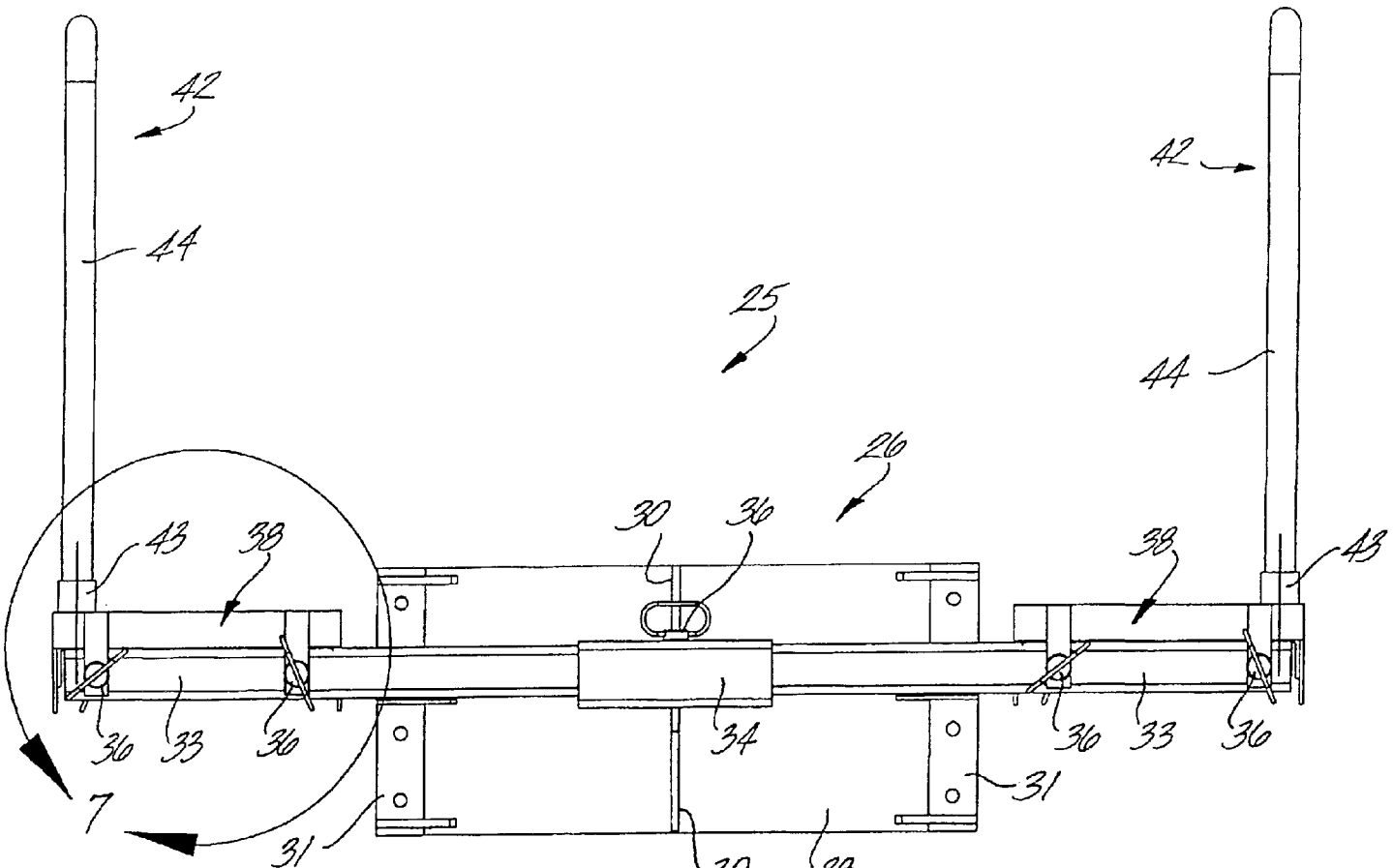
FIG. 6 is an end elevation view of the platform.

A blowout preventer (BOP) stack 10 is shown in FIG. 1. The stack can have a height of 30 or more feet between the bottom of a wellhead connector 11 at the bottom of the stack and the top of an annular BOP 12 at the top of the stack. The wellhead connector is secured via a bolting flange 14 at its upper end to a lower bolting flange 15 of a lower pair of ram-type BOPs 17 and 18. The annular BOP 12 is secured via a bolting flange 19 at its lower end to an upper bolting flange 20 of an upper pair of ram-type BOPs 22 and 23. Bolting flanges 14, 15, 19 and 20 are circular when seen in top plan view. Two similar central bolting connection flanges 21 and 24 (not shown in FIG. 1 because they are hidden by the structure of work support platform 25, but see FIG. 5 where flanges 21 and 24 are shown in phantom, i.e., by broken lines) provide a secure connection between BOPs 18 and 22 at about the middle of the height of stack 10. As is common in such assemblies, the lines (operational axes) along which the rams of BOPs 17, 18, 22 and 23 are movable are arranged to be parallel to each other. That is, the lengths of the ram BOPs are aligned in stack 10. The described components of the stack are spaced along a vertical axis of the stack.

A work platform 25 according to this invention is shown in various ways and details in FIGS. 2–8. As shown best in FIGS. 2 and 3, the platform has a base armature 26 by which it is connected about the central pair of BOP bolting flanges in stack 10. The armature provides the primary support structure for the work platform. The armature preferably is defined by two essentially identical components 27, each of which includes a vertically aligned essentially semi-circular cylindrical sleeve member 28 and a primary arm 29 affixed at one end to the sleeve member at the center of the sleeve member's arc to extend radially from the axis of the sleeve member. The primary arms preferably are formed from square or rectangular steel structural tube. Gussets 30 may be installed between the primary arm and the exterior of each sleeve member to rigidify the arm/sleeve connection. The radius of curvature of the inner surface of each sleeve member 28 corresponds to the radius of the cylindrical outer surface of the central bolting flanges in stack 10. The two sleeve members are engaged in secure clamped relation about the stack's central bolting flanges by being bolted together via bolting flanges 31 which extend radially outwardly in vertical planes at each side end of each sleeve member. The bolts provided for that purpose are not shown.

It is preferred that the arc of each sleeve member between its ends be slightly less than 180° to assure that they can be clamped tightly about the stack central bolting flanges. When the armature is assembled about the central stack bolting flanges, the sleeve members cooperate to form a collar by which the platform 25 is releasably mounted to the BOP stack. The armature preferably is connected to the BOP stack so its primary arms 29 are perpendicular to the height of the stack, are parallel to the aligned lengths of the ram BOPs, and lie between two adjacent ones of those BOPs. Suitable stiffening gussets can be connected between the armature bolting flanges and the exterior surfaces of the sleeve members as appropriate.

At their free ends opposite from the sleeve members 28, each primary arm 20 is arranged to securely yet releasably mount a corresponding one of a pair of platform cross arms 33. A presently preferred cross arm is defined by a length of square of rectangular steel structural tube of selected cross-sectional dimensions. A presently preferred way to connect each cross arm to a corresponding primary arm is to releasably pin the cross arm, at its midlength, to an encircling sleeve 34 affixed to the end of the primary arm as a component of the respective armature half 27. Sleeve 34 can be a short length of steel structural tube sized to enable a cross arm to be slid easily into it but not to rotate meaningfully relative to it. Each sleeve 34 has its length perpendicular to the adjacent primary arm and perpendicular to the axis of the collar defined by the sleeve members when coupled to each other via their bolting flanges. A securing pin 36 can pass through vertically aligned holes in each sleeve 34 and cross arm as shown to hold a cross arm from movement in its mounting sleeve. Each securing pin can have a resilient detent to hold it in place in use. If desired, each securing pin can be a bolt secured by a bottom nut bearing against the bottom of sleeve 34.

Depending upon circumstances of use, the armature 26 of platform 25 can become an essentially permanent component of BOP stack 10. That is, it can be left in place on the stack after other parts of the platform have been disconnected from it. If it is left in place, its arms 29 are vertically below and in alignment with the ram housings of preventor 23, and between preventers 18 and 23, where they are shielded by the preventers above and below them. Arms 29 are out of the way to be protected from damage by or interference with other equipment before and after connection of the BOP stack to a wellhead.

When cross arms 33 have been connected to an installed armature 26, the plan configuration of the cross arms and the armature resembles an "H". The cross arms form the legs of the "H". A pair of elongate structural work deck units 38 are provided. Each deck unit is connectible between the cross arm ends to be parallel to the elongate extent of the armature. Each deck unit is structurally adequate to support the load of a desired number of workers and their tools and equipment. Each deck unit preferably is rectangular in plan shape as defined by a peripheral frame 39. The frame supports elements which define a worker support surface. As shown, those elements can be a series of spaced and parallel bars connected between the long sides of the frame. Alternately, the worker support surface can be defined by expanded metal grating or the like. A lightweight yet strong deck unit construction is preferred.

Figure 7:
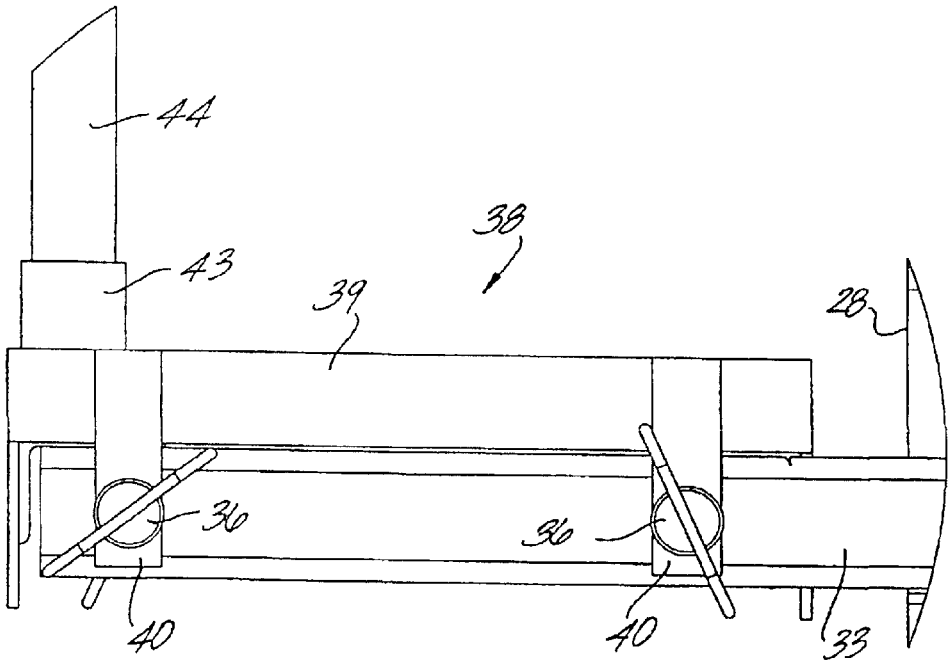
FIG. 7 is an enlarged view of the structure shown in circle 7 of FIG. 6.
Figure 8:
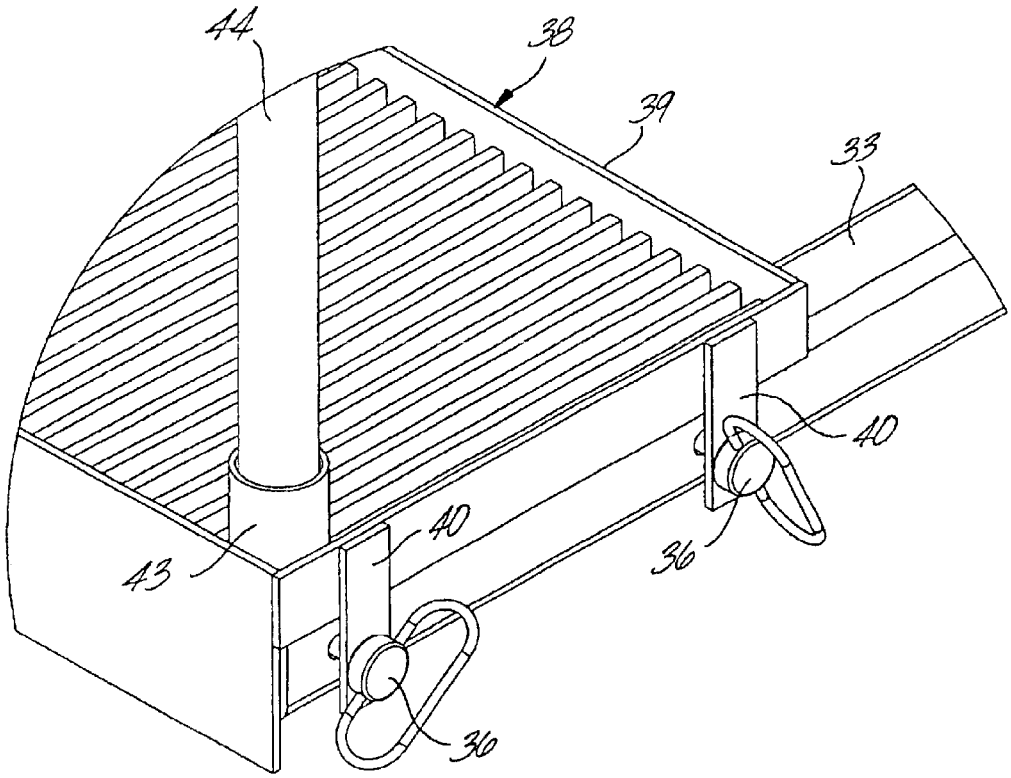
FIG. 8 is an enlarged view of the structure shown in circle 8 of FIG. 2.

Each deck unit 38 is releasably secured to its supporting cross arms. While many ways to releasably secure the deck units to the cross arms are possible, a preferred way is shown in FIGS. 7 and 8. A deck unit is supported atop the cross arms. A pair of brackets 40 can extend downwardly from the deck unit frame at each end of the frame to lie adjacent the cross arm surfaces at the ends of the armature. A securing pin 36 can be passed through a hole in the lower end of each bracket and into or through the adjacent cross arm via suitable holes in the cross arm. The securing pins can be releasably held in engaged relation to the cross arms in any suitable and convenient way, including those ways described above.

For enhanced safety of personnel using an installed work platform 25, a guard rail assembly 42 preferably is provided along the outer side of each deck unit 38. The outer side is the deck unit long side which is remote from, not adjacent to, the armature 26 in the installed state of the deck unit in the platform. A rail assembly can be a permanent component of a deck unit. However, for ease of stowability of the subassemblies of platforms 25, it is preferred that the rail assemblies be separable from the deck units. It is convenient to provide suitable upwardly open sockets 43 in the deck units to receive the lower ends of vertical posts 44 which are components of the rail assemblies. While not shown, retainer pins 36 or the like can be used to releasably secure posts 44 in sockets 43.

The overall dimensions of a convenient work platform 25 are about 10 feet 6 inches in length, about 6 feet 4 inches in width, and about 3 feet 4 inches in height from deck unit surface to the top of a rail assembly. Such a work platform provides a suitably spacious safe work area in which persons inspecting, servicing or repairing equipment in the upper portion of BOP stack 10 can perform their tasks efficiently without hindrance by harnesses, slings and the like. The ready connectibility and disconnectibility of the several component subassemblies of the platform enables the platform to be quickly assembled and disassembled when needed.

An access ladder can be provided to an end of each deck unit of the installed work platform.

While, as described, a work platform arrangement which is disconnectible from armature 26 is preferred.

What is claimed is:

1. A work platform for a blowout preventer stack having connection flanges intermediate the height of the stack, the platform comprising an armature which includes a pair of arm members each arranged at one of two opposite ends thereof for clamping interconnecting engagement with the other arm member around the stack connection flanges in which engagement the arm members are substantially collinearly aligned, a structural arm end member connectible to the other end of each arm member to extend laterally from the arm member, and a deck structure supportable on the arm end members, and in which, in the connected state of the arm members to the preventer stack and of the end members to the arm members, the arm members and end members define an "H" configuration in which the "H" legs are formed by the end members.

2. The work platform according to claim 1 in which the deck structure comprises a pair of elongate deck units each of which is connectible at its ends to corresponding ends of the arm end members.

3. The work platform according to claim 2 in which the deck units are releasably connectible in essentially fixed relation to the arm end members.

4. The work platform according to claim 2 including a guard rail assembly for each deck unit.

5. The work platform according to claim 1 in which the end members are releasably connectible to the arm members.

6. In combination with a blowout preventer stack having arc shaped connection flanges intermediate the height of the stack, a work platform which comprises a platform armature connected to the stack about the connection flanges and the armature providing when so connected a pair of arms extending in opposite directions from the connection flanges, and structural arm end members connected to respective outer ends of the arms to extend substantially perpendicularly from the arms, and a removable personnel support deck structure supportable on the end members.

7. The combination according to claim 6 in which the deck structure extends parallel to the arms.

8. The combination according to claim 6 wherein the preventer stack connection flanges are between vertically adjacent ram preventers, and the arm members are disposed between and in substantial alignment with those ram preventers.

9. The combination according to claim 8 in which the deck structure includes a pair of elongate deck units disposed substantially parallel to those ram preventers on opposite sides of the preventer stack.

10. A work platform for a blowout preventer stack which includes plural ram preventers arranged with their operational axes parallel to each other and spaced along a stack axis and which includes arc shaped connection flanges between adjacent preventers intermediate the height of the stack, the work platform comprising a support armature securable to the stack at the connection flanges to locate structural platform support arms of the armature in a plane normal to the stack axis and between and substantially in the plane of the operational axes of said adjacent preventers, and a removable personnel supporting deck structure supportable by the arms.

11. A method for supporting personnel adjacent upper portions of a blowout preventer stack having arc shaped connection flanges intermediate the height of the stack between two adjacent ram preventers having parallel operational axes, the method comprising the step of supporting via the connection flanges a work platform substantially at the vertical location of the connection flanges of the stack during times of personnel activity requiring access to upper portions of the stack, the platform including removable structural support elements disposed between the adjacent preventers and substantially parallel to their operational axes.

12. The method according to claim 11 including the further step of disconnecting and removing from the structural support elements components of the platform supported by the support elements during other times of lack of need for personnel access to upper portions of the stack.

* * * * *

UNITED STATES PATENT AND TRADEMARK OFFICE

CERTIFICATE OF CORRECTION

PATENT NO. : 6,848,539 B2
DATED : February 1, 2005
INVENTOR(S) : Lee et al.

It is certified that error appears in the above-identified patent and that said Letters Patent is hereby corrected as shown below:

Title page,
Item [75], Inventors, delete "Oral Robert" insert -- Oral Roberts --.
Insert Item:
-- Related U.S. Application Data
[60] Provisional application No. 60/228,475 filed on Aug. 28, 2000 --.

Signed and Sealed this

Twenty-third Day of August, 2005

JON W. DUDAS
*Director of the United States Patent and Trademark Office*